US008388030B2

(12) United States Patent
Takahashi et al.

(10) Patent No.: US 8,388,030 B2
(45) Date of Patent: Mar. 5, 2013

(54) DOOR LATCH DEVICE IN A MOTOR VEHICLE

(75) Inventors: Akira Takahashi, West Bloomfield, MI (US); Bryan Farris, Livonia, MI (US)

(73) Assignee: Mitsui Mining and Smelting Co., Ltd., Tokyo (JP)

( * ) Notice: Subject to any disclaimer, the term of this patent is extended or adjusted under 35 U.S.C. 154(b) by 435 days.

(21) Appl. No.: 12/411,218

(22) Filed: Mar. 25, 2009

(65) Prior Publication Data

US 2009/0241617 A1 Oct. 1, 2009

(30) Foreign Application Priority Data

Mar. 31, 2008 (JP) ..... 2008-093141

(51) Int. Cl.
*E05C 3/06* (2006.01)
*E05B 65/06* (2006.01)

(52) U.S. Cl. ..... 292/201; 292/216; 49/394

(58) Field of Classification Search ..... 292/201, 292/216, DIG. 23; 49/394
See application file for complete search history.

(56) References Cited

U.S. PATENT DOCUMENTS

| | | | | |
|---|---|---|---|---|
| 4,929,007 | A * | 5/1990 | Bartczak et al. | 292/336.3 |
| 5,054,827 | A * | 10/1991 | Konchan et al. | 292/216 |
| 5,277,461 | A * | 1/1994 | Dzurko et al. | 292/216 |
| 5,295,374 | A * | 3/1994 | Bender et al. | 70/208 |
| 5,438,855 | A * | 8/1995 | Ikeda | 70/279.1 |
| 5,494,322 | A * | 2/1996 | Menke | 292/216 |
| 5,802,894 | A * | 9/1998 | Jahrsetz et al. | 70/264 |
| 5,887,466 | A * | 3/1999 | Yoshizawa | 70/257 |
| 5,896,767 | A * | 4/1999 | Gomi | 70/237 |
| 6,148,651 | A * | 11/2000 | Roncin | 70/264 |
| 6,406,073 | B1 * | 6/2002 | Watanabe | 292/216 |

FOREIGN PATENT DOCUMENTS

WO 2006/099730 A1 9/2006

* cited by examiner

*Primary Examiner* — Thomas Beach
*Assistant Examiner* — Nathan Cumar
(74) *Attorney, Agent, or Firm* — Fennemore Craig, P.C.

(57) ABSTRACT

A door latch device in a motor vehicle comprises an engagement portion including a latch which engages with a striker of a vehicle body. The door latch device comprises an inner lever connected to an inside handle, a lock lever connected to a lock knob on a door inside the vehicle, a subsidiary lever connected to the lock lever, a childproof lock lever, a motor and an actuating member driven by the motor to actuate the childproof lock lever. Childproof locking and a double locking can be carried out by the single motor.

5 Claims, 9 Drawing Sheets

DOOR LATCH DEVICE IN A MOTOR VEHICLE

BACKGROUND OF THE INVENTION

The present invention relates to a door latch device in a motor vehicle and particularly to a door latch device in a motor vehicle, the door latch device being placed in a double-lock state for deactivating unlocking of a lock knob inside the vehicle and a childproof lock state for deactivating an operation of an inside handle inside the vehicle.

Besides a normal lock and unlock mechanism, a door latch device in a motor vehicle provides the structure that shifts a double lock state that prevents a lock knob inside the vehicle from being wrongfully unlocked or shifted to an unlocking state, and the childproof structure for preventing a door from opening even if an inside handle is operated by children in the vehicle intentionally or wrongfully for opening as disclosed in WO2006/099730A1, particularly in FIG. 5.

However, in the door latch device therein, double lock is carried out by a double lock motor, while childproof locking is carried out by a childproof lock motor. To carry out both double locking and childproof locking, it is necessary to provide two motors involving high cost for manufacturing.

SUMMARY OF THE INVENTION

In view of the disadvantage, it is an object of the invention to provide a door latch device in a motor vehicle, allowing childproof locking and double locking by a single motor.

BRIEF DESCRIPTION OF THE DRAWINGS

The features and advantages of the invention will become more apparent from the following description with respect to an embodiment as shown in accompanying drawings.

DETAILED DESCRIPTION OF PREFERRED EMBODIMENT

Figure 2:
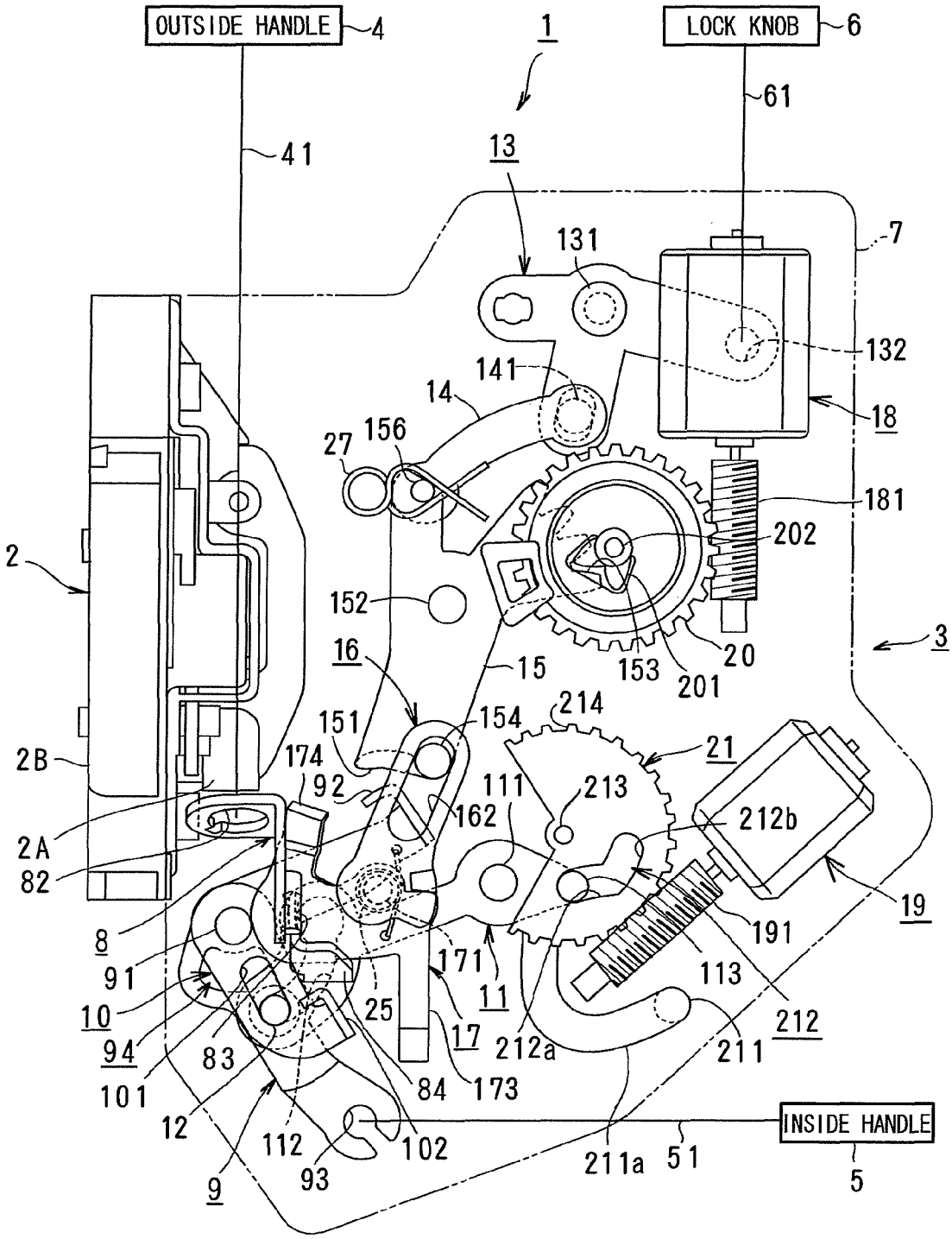
FIG. 2 is a front elevational view of the door latch device in a locked state.

The right side in FIG. 2 and the left side in FIGS. 3-12 are a front of a motor vehicle, and the left side in FIG. 2 and right side in FIGS. 3-12 are a rear thereof. The front in FIG. 2 and the back in FIGS. 3-12 are the outside of the vehicle, and the back in FIG. 2 and the front in FIGS. 3-12 are the inside thereof.

A door latch device 1 is disposed at the rear end of a rear door of the motor vehicle, and comprises an engagement portion 2 for holding the door in a closed position and an actuating portion 3 for actuating the engagement portion 2.

Figure 3:
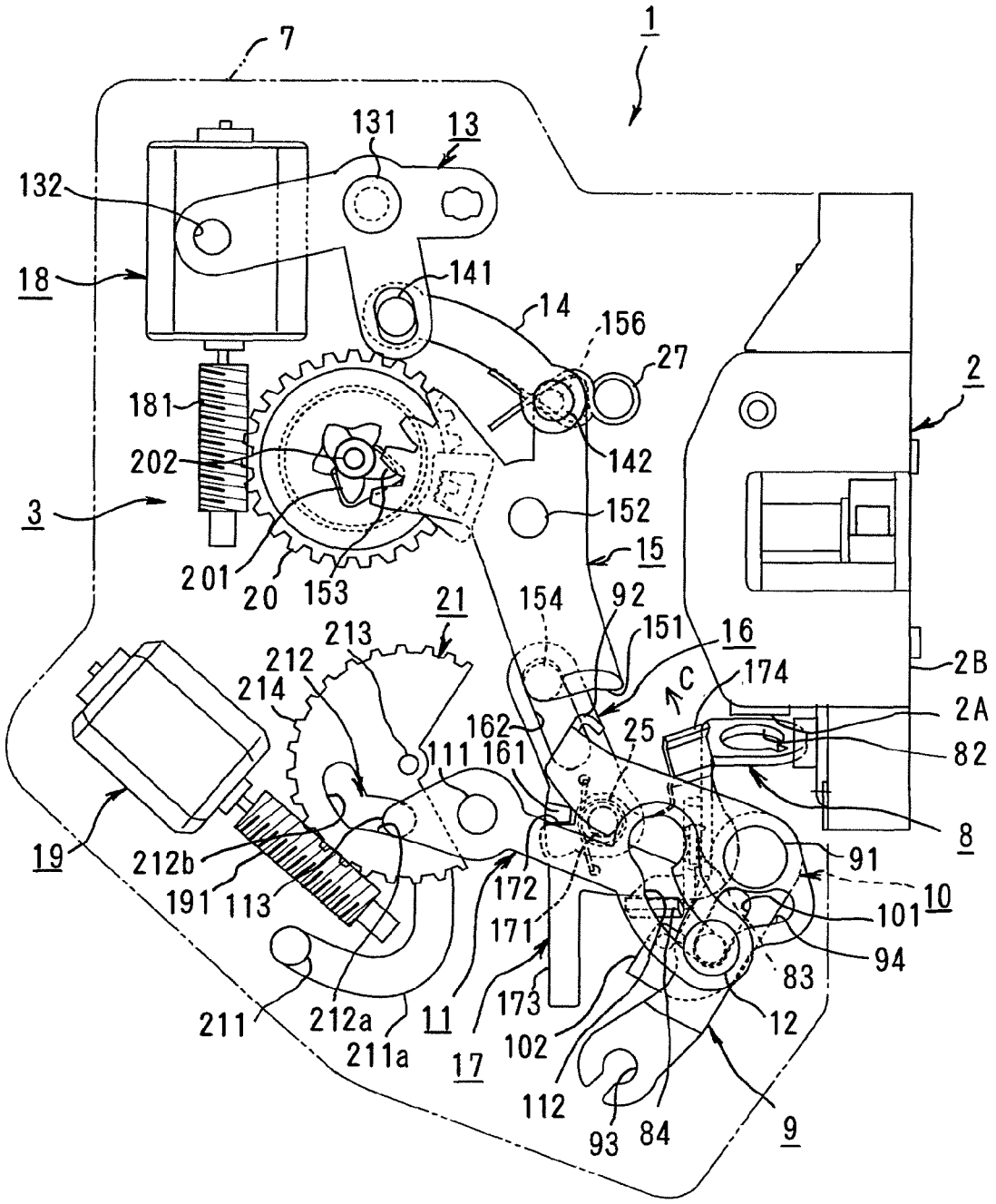
FIG. 3 is a rear elevational view of the door latch device in the locked state.
Figure 4:
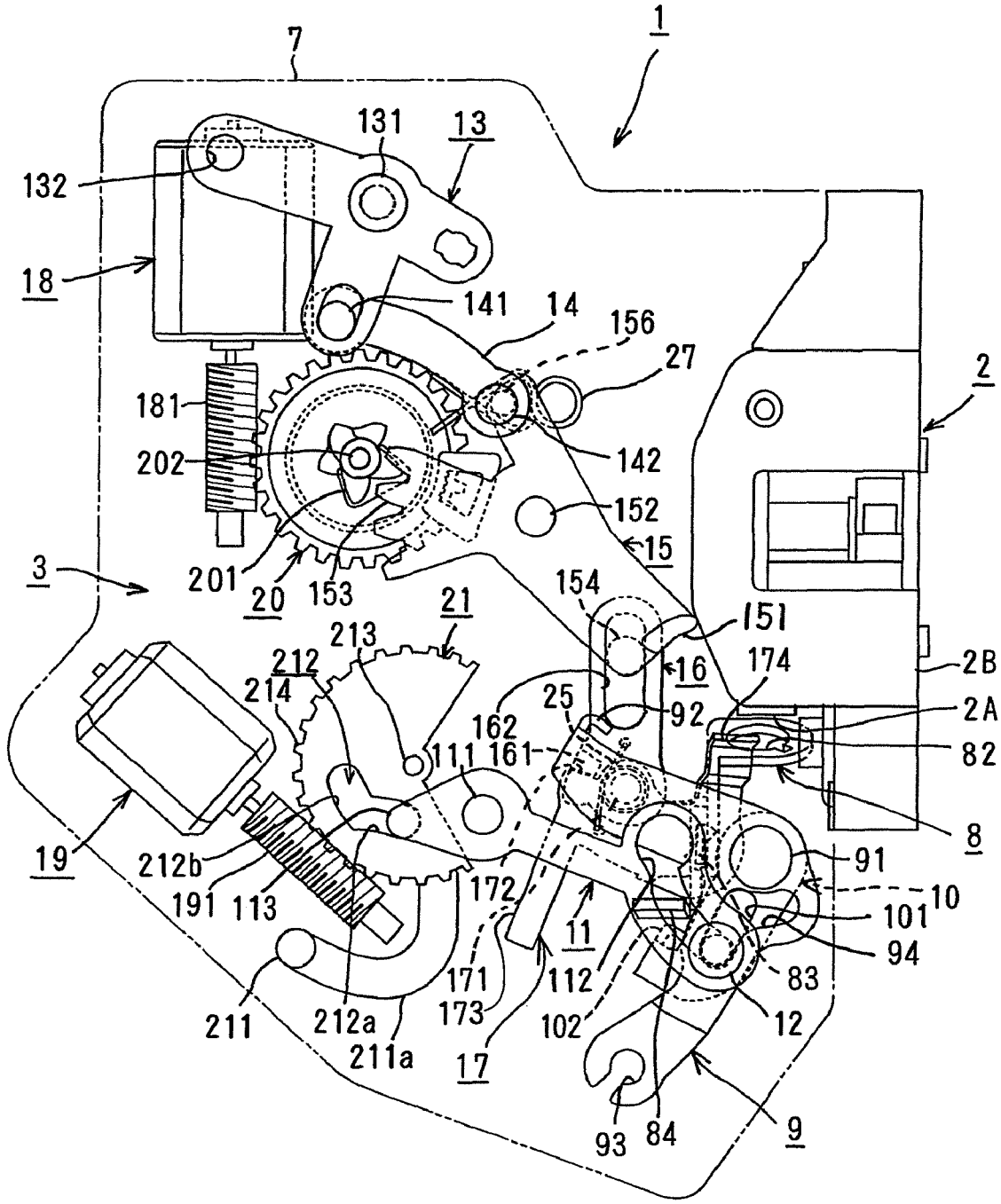
FIG. 4 is a rear elevational view of the door latch device in an unlocking state.
Figure 6:
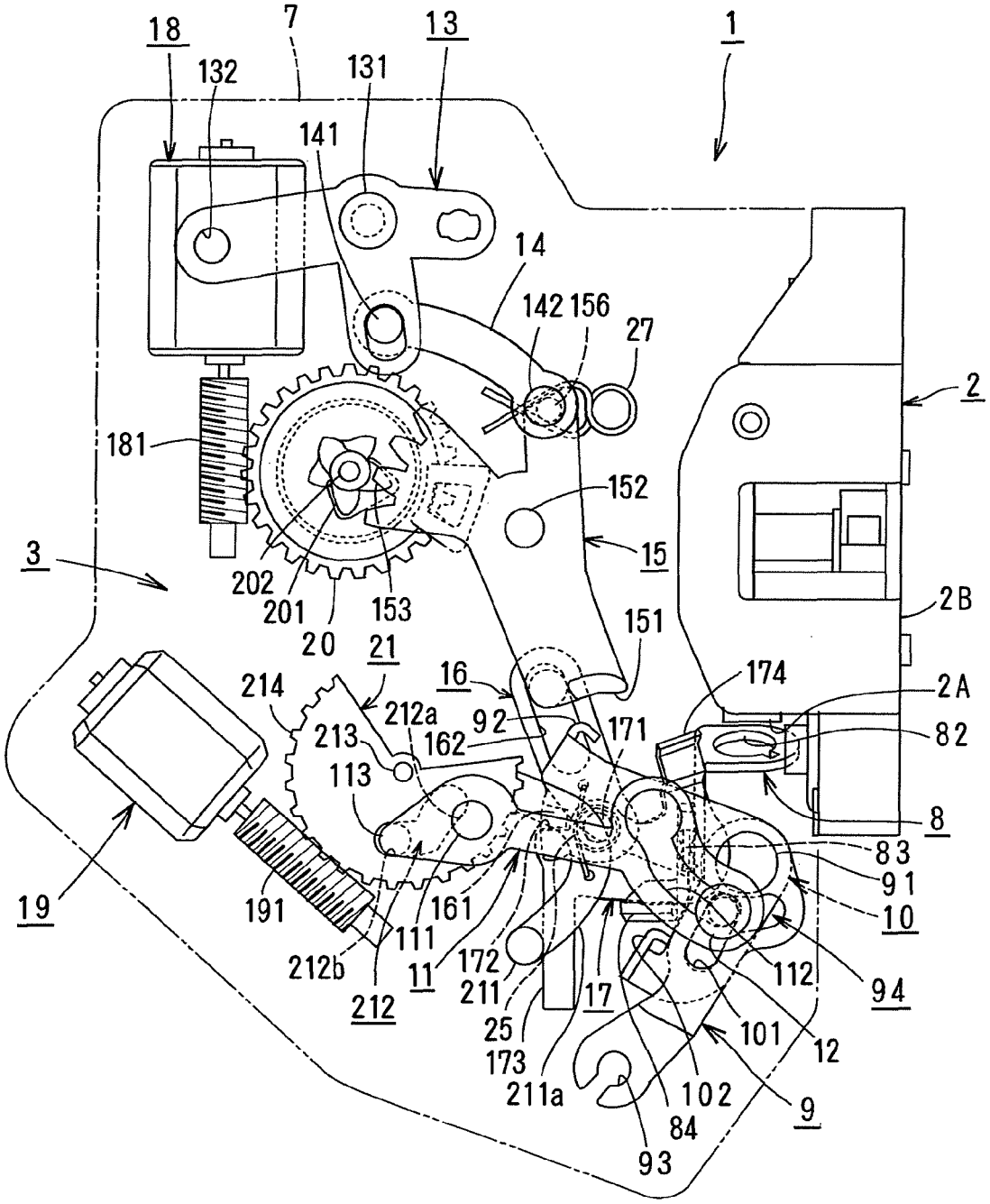
FIG. 6 is a rear elevational view of the door latch device in a double-lock state.

The door latch device 1 can be shifted among an unlocking state in FIG. 4 where the door can be opened with an outside handle 4 outside the vehicle or an inside handle 5 inside the vehicle, a locked state in FIGS. 2 and 3 where the door cannot be opened with the outside handle 4 but can be opened by double actions with the inside handle 5, a childproof locked state where the door can be opened with the outside handle 4 but cannot be opened with the inside handle 5, and a double-lock state in FIG. 6 where the door cannot be opened with the outside handle 4 or inside handle 5 while neither double actions of the inside handle 5 nor unlocking of the locking knob in FIG. 2 inside the vehicle is invalidated.

The double actions mean that the inside handle 5 changes the actuating portion 3 from the locked position to the unlocking position, and that the engagement portion 2 is then released. The childproof locked state means that first and second locking levers 13,15 and first and second subsidiary levers 16,17 are moved to the unlocking position in FIG. 5.

The engagement portion 2 comprises a body 2B fixed to the rear end within the door with a plurality of bolts (not shown); a latch (not shown) adapted to engage with a striker (not shown) fixed to the vehicle; a ratchet (not shown) pivotally mounted in the body 2B and adapted to engage with the latch; and an opening lever 2A turning together with the ratchet. When the door is closed, the striker engages with the latch and the ratchet prevents the latch from turning in an opening direction. The opening lever 2A turns in a releasing direction as shown by an arrow A in FIG. 1 to enable the door to open. The engagement portion is known and does not relate to the present invention. Detailed description thereof is omitted.

Figure 1:
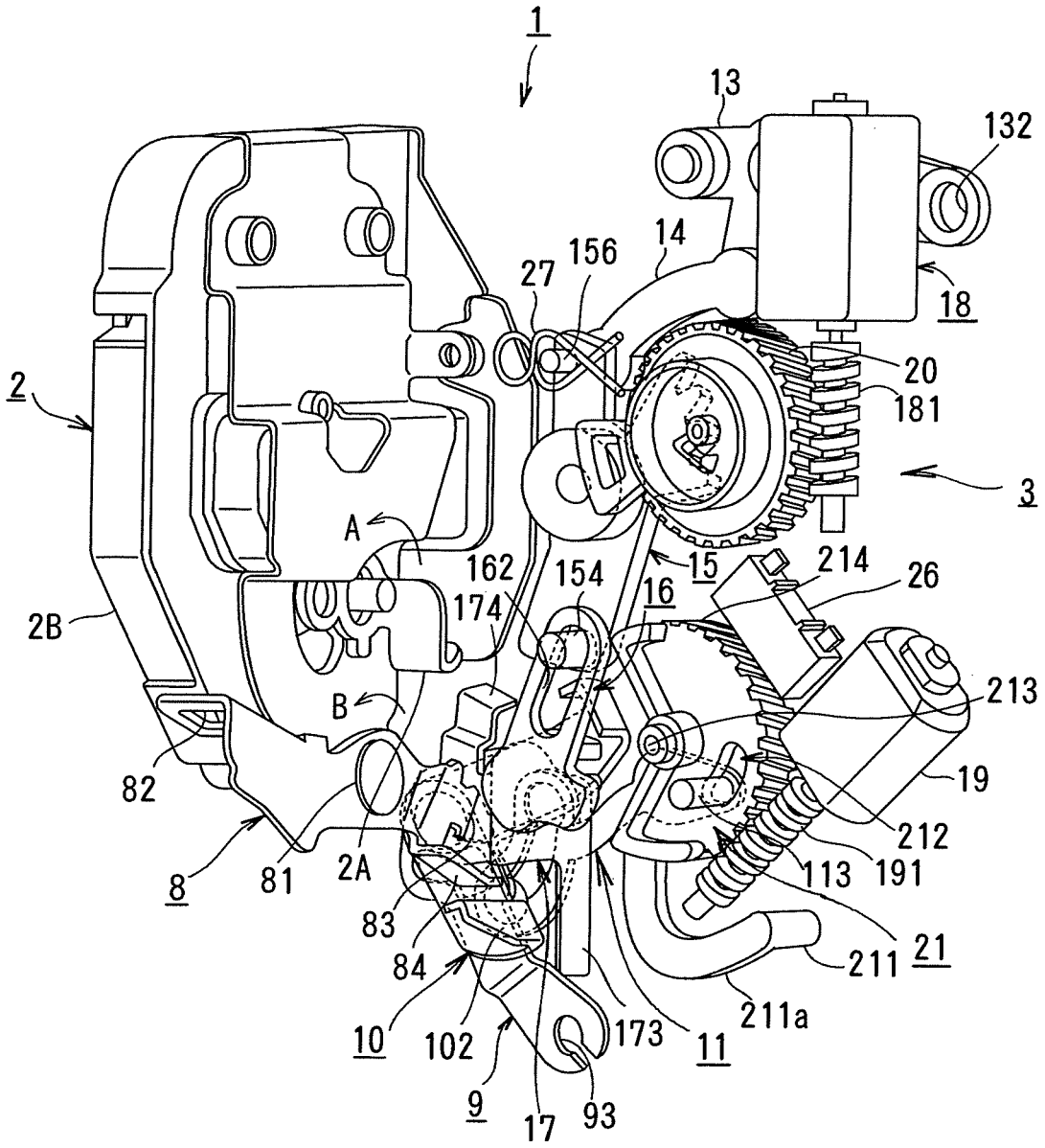
FIG. 1 is a perspective view of a door latch device according to the present invention.

A synthetic resin cover 7 is mounted over the front face of the body 2B. In FIG. 1, the cover 7 is omitted so as to show the actuating portion 3 in the cover 7.

The actuating portion 3 comprises an outer lever 8 connected to the outside handle 4 via a rod 41 for transmitting an actuating force in FIG. 2; a first inner lever 9 connected to the inside handle 5 via a cable 51 for transmitting an actuating force in FIG. 2; a second inner lever 10 acting together with the first inner lever 9 when it is not in the childproof locked state; a childproof lock lever 11 actuated in the childproof locked state; a first lock lever 13 moving together with the lock knob 6; a second lock lever 15 connected to the first lock lever 13 via a link 14; a first subsidiary lever 16 connected to the second lock lever 15; a second subsidiary lever 17 connected the outer lever 8; a lock motor 18; a childproof-double-lock motor 19; a worm wheel 20 driven by the lock motor 18; and an actuating member 21 driven by the childproof-double-lock motor 19.

The outer lever 8 is pivotally mounted on a pivot shaft 61 extending longitudinally of the vehicle at the lower part of the cover 7 in FIG. 1 and turns in a releasing direction as shown by an arrow B in FIG. 1 against the force of a spring (not shown) with the outside handle 4 for opening the door. To the outer side end 82 of the outer lever 8, the lower end of the rod 41 is coupled, and the second subsidiary lever 17 is coupled to the inner side end 83 to allow the second subsidiary lever 17 to turn by a certain angle longitudinally of the vehicle.

The first inner lever 9 is pivotally mounted on a pivot shaft 91 extending transversely of the vehicle at the lower part of the cover 7. An unlocking portion 92 is provided at the upper part to contact an unlocked portion 151 of the second lock lever 15 and a connecting portion 93. One end of the cable 51 is connected to the inside handle 5, and the other end thereof is connected to the connecting portion 93. An L-like cam hole 94 is formed about the pivot shaft 91 of the first inner lever 9 and is in sliding contact with a control pin 12. The control pin 12 moves between an unlocking position where the pin 12 is apart from the pivot shaft 91 in FIGS. 2-4 and a locked position where the pin 12 is in the corner of the cam hole 94 in FIGS. 5 and 6 with the childproof lock lever 11.

The second inner lever 10 is pivotally mounted on the same axis as the first inner lever 9 and has an elongate hole 101 in which the control pin 12 slides, over the cam hole 94 of the inner lever 9. The second inner lever 10 has a contact portion 102 which contacts a bent portion 84 of the outer lever 8.

When the control pin 12 is in the unlocking position, the control pin 12 engages in the cam hole 94. In order to open the door with the inside handle 5, the first and second inner levers 9, 10 turns on the pivot shaft 91 in the releasing direction anticlockwise in FIG. 2 or clockwise in FIGS. 3-7 from a standby position in FIGS. 2-7. When the second inner lever 10 turns in the releasing direction, the contact portion 102 of the second inner lever 10 gets in touch with the bent portion 84 upward to allow the outer lever 8 to turn in the releasing direction.

Figure 7:
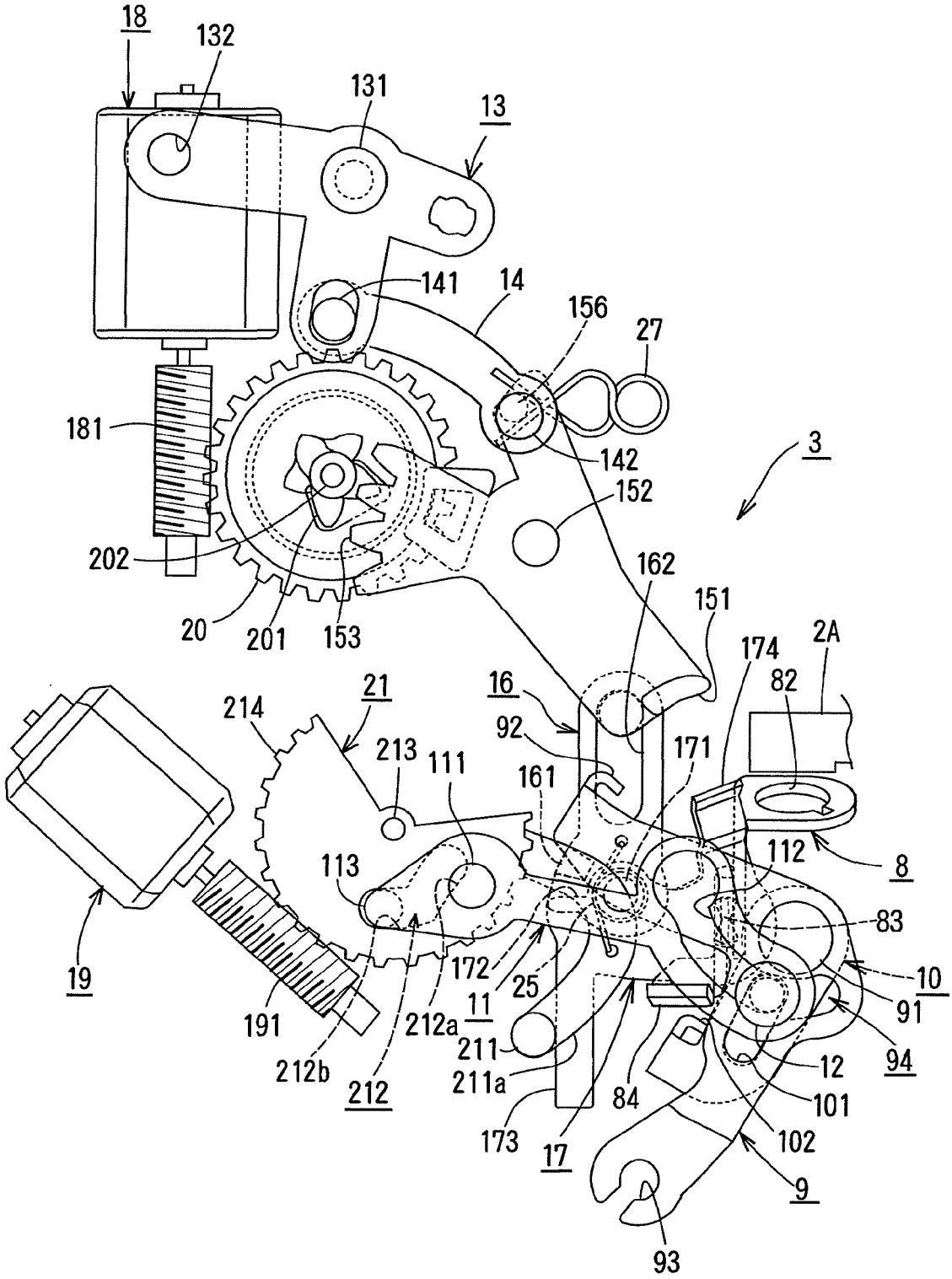
FIG. 7 is an enlarged rear view when a lock knob is unlocked in the double lock state.
Figure 8:
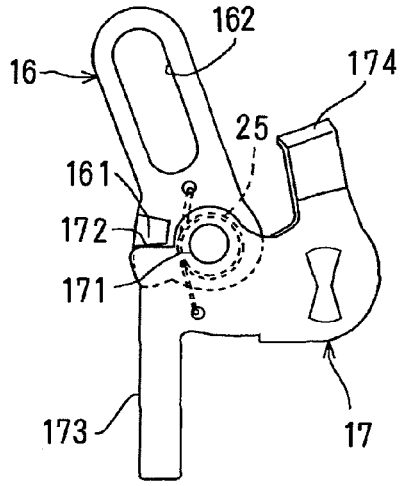
FIG. 8 is an enlarged rear view of the first and second subsidiary levers.
Figure 9:
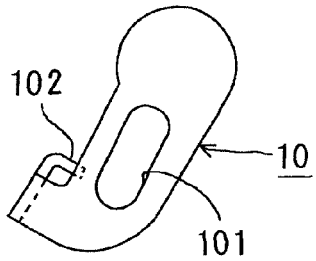
FIG. 9 is an enlarged rear view of the second inner lever.
Figure 10:
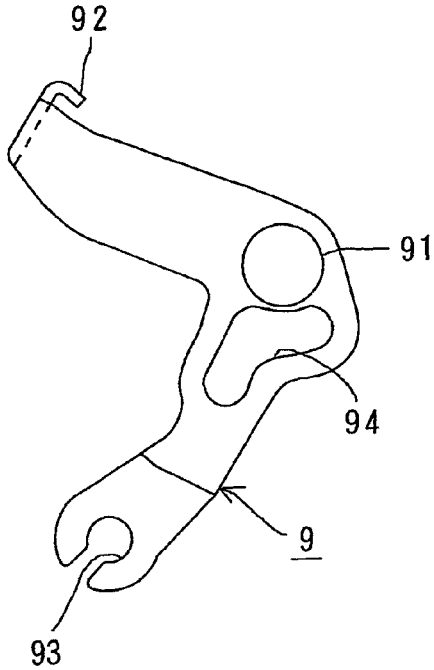
FIG. 10 is an enlarged rear view of the first inner lever.
Figure 11:
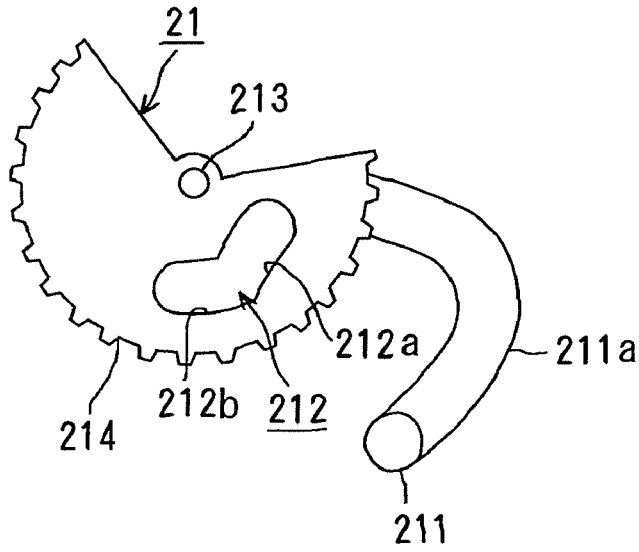
FIG. 11 is an enlarged rear view of an actuating member.
Figure 12:
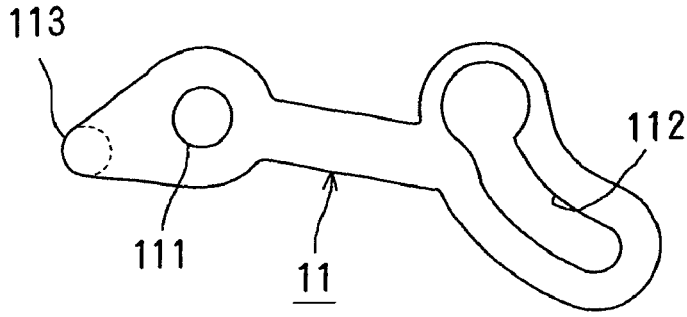
FIG. 12 is an enlarged rear view of a childproof lock lever.

The first lock lever 13 is pivotally mounted at the upper part of the cover 7 on a pivot shaft 131 extending transversely of the vehicle and is movable between the unlocking position in FIG. 4 and 7 and the locked position in FIGS. 2,3,5,6. A connecting portion 132 at the rear end of the first lock lever 13 is connected to the lock knob 6 via the connecting rod 61. The lower end of the first lock lever 13 is pivotally connected to a connecting shaft 141 at the upper end of the link 14.

The second lock lever 15 is pivotally mounted to the cover 7 on a pivot shaft 152 extending longitudinally of the vehicle and is movable with the first lock lever 13 between the unlocking position in FIGS. 4 and 7 and the locked position in FIGS. 2, 3, 5 and 6. A projection 156 elastically engages with a spring 27 supported by the cover 7, so that the second lock lever 15 is held with a certain elastic holding force in the unlocking and locked positions. The elastic force of the spring 27 is set to be greater that a force of a spring exerting between the first subsidiary lever 16 and the second subsidiary lever 17.

A sector gear 153 at the frond end of the second lock lever 15 meshes with a smaller-diameter gear 201 of the worm wheel 20. The upper end of the second lock lever 15 is pivotally connected to a link shaft 142 at the lower end of the link 14 to allow the second lock lever 15 to be connected to the first lock lever 13. A projection 154 on the lower end engages in a slot 162 of the first subsidiary lever 16 to slide therein. Opposite the projection 154 of the second subsidiary lever 15, an unlocked portion 151 projects to get in touch with the unlocking portion 92 of the first inner lever 9.

The worm wheel 20 is pivotally mounted to the cover on a pivot shaft 202; meshes with a worm 181 around an output shaft of the lock motor 18; and is forced toward a neutral position with a neutral-position-returning spring (not shown) provided against the cover 7. The worm wheel 20 meshes with the worm 181 and rotates reversibly.

When the lock motor 18 turns for unlocking, the worm wheel 20 turns at certain angles against the neutral-position-returning spring from the neutral position in the unlocking direction or clockwise in FIG. 3. With the rotation, after the second lock lever 15 turns from the locked position to the unlocking position, the worm wheel 20 returns to the neutral position again by the force of the neutral-position-returning spring when the lock motor 18 stops. The gear 201 of the worm wheel 20 meshes with the second sector gear 153 of the second lock lever 15 such that the second lock lever 15 does not run with the returning rotation of the worm wheel 20 when the worm wheel 20 returns to the neutral position by force of the neutral-position-returning spring from a state where the worm wheel 20 turns.

The lock knob 6 is actuated from the unlocking position to the locked position, the first lock lever 13 turns around the pivot shaft 131 from the unlocking position to the locked position. The second lock lever 15 moves with the first lock lever 13 via the link 14 and turns around the pivot shaft 152 from the unlocking position to the locked position. When the lock knob 6 is actuated for unlocking from the locked position, the first lock lever 13 turns around the pivot shaft 131 from the locked position to the unlocking position. The second lock lever 15 moves with the first lock lever 13 via the link 14 and turns around the pivot shaft 152 from the locked position to the unlocking position. Being driven by the lock motor 18 in the locking direction, the second lock lever 15 turns from unlocking position to the locked position with the rotation of the worm wheel 20, and the first lock lever 13 moves with the second lock lever 15 via the link 14 and turns from the unlocking position to the locked position. Being driven by the lock motor 18 for unlocking, the second lock lever 15 turns from the locked position to the unlocking position with the rotation of the worm, and the second lock lever 15 turns from the locked position to the unlocking position with the rotation of the worm wheel 20. The first lock lever 13 moves with the second lock lever 15 via the link 14 and turns from the locked position to the unlocking position.

The second subsidiary lever 17 is pivotally mounted to the inner side end 83 to turn at certain angles and is movable between the unlocking position in FIGS. 4 and 7 and the locked position in FIGS. 2, 3, 5, 6 and 7 with the lock knob 6 and lock motor 18 when the outer lever 8 is in the standby position so far as it is not in the double-lock state. Thus, when the outer lever 8 turns in a releasing direction, the second subsidiary lever 17 moves upwards for releasing while it still remains in the unlocking or locked position.

At the front end of the second subsidiary lever 17, there is a blocked portion 173 which can get in touch with a blocking portion 211 of an actuating member 21 in a third position when the second subsidiary lever 17 is in the locked position. At the upper rear end of the second subsidiary lever 17, there is a release-contact portion 174 which can get in touch with the opening lever 2A when the second subsidiary lever 17 is in the unlocking position, and which cannot get in touch with the lever 2A when the second subsidiary lever 17 is in the locked position.

The second subsidiary lever 17 in the unlocking position goes upwards with releasing movement of the outer lever 8 to allow the releasing-contact portion 174 to contact the opening lever 2A, which turns in the releasing direction to allow the ratchet to disengage from the latch. Meanwhile, even if the second subsidiary lever 17 in the locked position is actuated for releasing, the releasing-contact portion 174 merely swings without contacting the opening lever 2A to make it impossible for the opening lever 2A to turn for releasing, so that the ratchet cannot disengage from the latch.

The first subsidiary lever 16 is pivotally mounted to the front part of the second subsidiary lever 17 on a shaft 171. The slot 162 is in sliding engagement with the projection 154 of the second lock lever 15. Around the shaft 171 of the first subsidiary lever 16, there is an engaged portion 161 which is engagable with an engagement portion 172 of the second subsidiary lever 13 anticlockwise in FIG. 3.

Around the shaft 171, a spring 25 is wound and has one end engaging with the first subsidiary lever 16 and the other end engaging with the second subsidiary lever 17. The force of the spring 25 exerts onto the first subsidiary lever 16 so that the engaged portion 161 may get in touch with the engagement portion 172 of the second subsidiary lever 17 to allow the first subsidiary lever 16 to be held in a normal position where the engaged portion 161 contact the engagement portion 172 in FIGS. 2-6. Therefore, when it is not in the double lock position or is in the normal position, the first subsidiary lever 16 and second subsidiary lever 17 goes together to the unlocking and locked positions by a holding force of the spring 25. In the double lock position, even when the second subsidiary lever 17 is held in the locked position by the actuating member 21, only the first subsidiary lever 16 can turn against the force of the spring 25 from the normal position to the unlocking position in FIG. 7 not to prevent the lock knob 6 and first and second lock levers 13, 15 from going from the locked position to the unlocking position.

Figure 5:
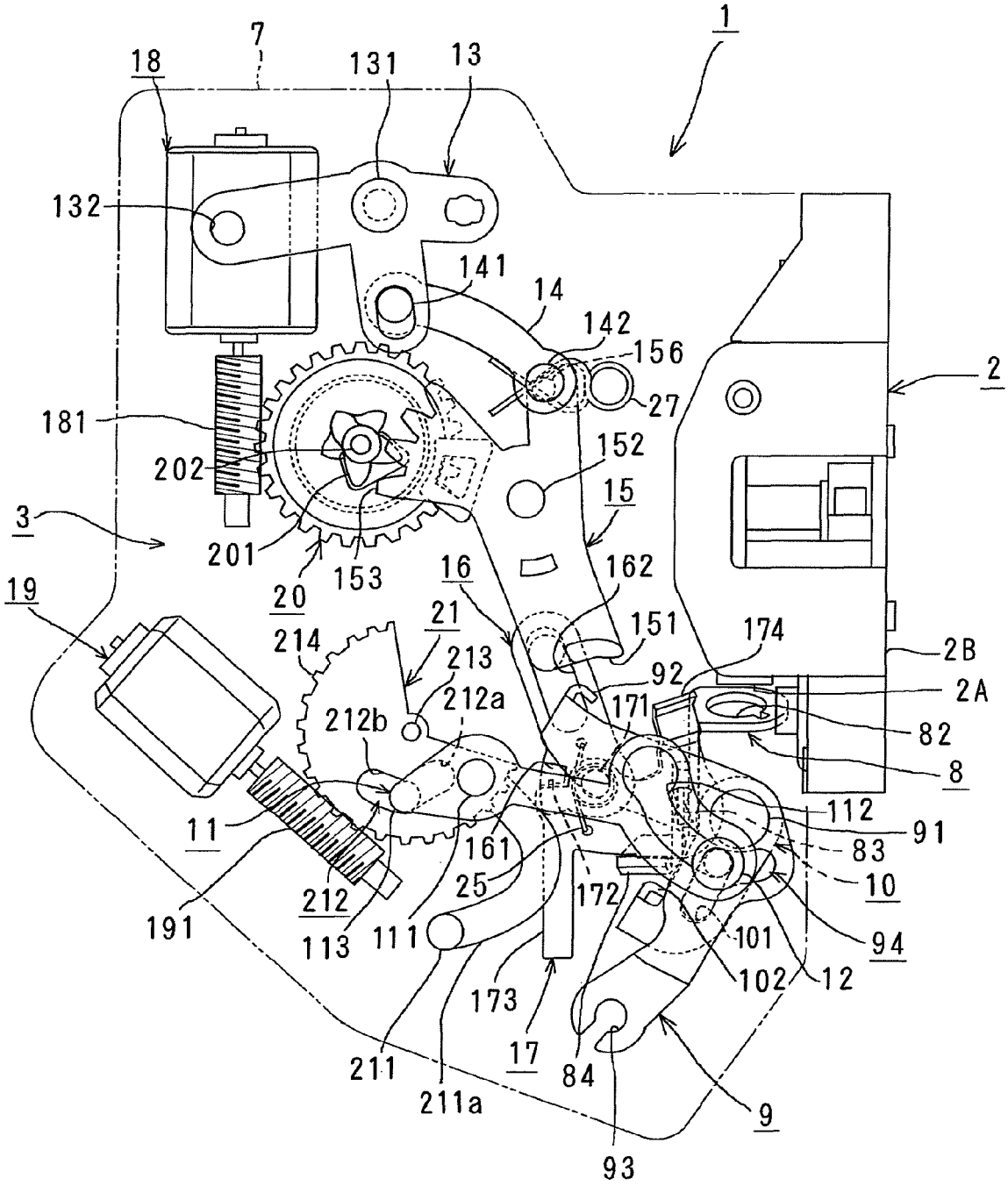
FIG. 5 is a rear elevational view of the door latch device in a childproof lock state.

The childproof lock lever 11 is pivotally mounted to the lower part of the cover 7 on the pivot shaft 111 to turn from a childproof unlocking position in FIGS. 2-4 for validating the inside handle 5 to a childproof locked position in FIGS. 5-7 for deactivating the inside handle 5 and vice versa. At the rear part of the childproof lock lever 11, a guide opening 112 is formed, and the control pin 12 is in sliding engagement with the guide opening 112. When the childproof lock lever 11 is in the childproof unlocking position, the guide opening 112 comprises an arc of a circle around the pivot shaft 91. At the front end of the childproof lock lever 11, a projection 113 is formed and is in sliding contact with a cam 212 of the actuating member 21.

When the childproof lock lever 11 comes to the childproof unlocking position, the control pin 12 in the guide opening 112 comes to the unlocking position to make connection so that the first inner lever 9 and second inner lever 10 can turn together. In order that the door may be opened with the inside handle 5, the first inner lever 9 turns in the releasing direction, so that the second inner lever 10 turns in the releasing direction. When the childproof lock lever 11 comes to the childproof locked position, the control pin 12 moves to the locked position in which the first inner lever 9 is disconnected from the second inner lever 10. Even when the inside handle 5 is operated for opening the door to turn the first inner lever 9 in the releasing direction, the second inner lever 10 does not turn in the releasing direction.

The actuating member 21 is pivotally mounted to the lower part of the cover 7 on a pivot shaft 213. Teeth on the outer circumference of the actuating member 21 mesh with a worm 191 on an output shaft of a childproof-double-lock motor 19. With the rotation of the motor 19, the actuating member 21 moves around the pivot shaft 213 and is held among the first position, the second position and the third position. The first position is in FIGS. 2-4 where the childproof lock lever 11 is moved to the childproof unlocking position; the second position is in FIG. 5 where the childproof lock lever 11 is moved to the childproof locked position; and the third position is in FIGS. 6 and 7 where the second subsidiary lever 17 is held in the locked position while the childproof lock lever 11 is still kept in the childproof locked position. The second position of the actuating member 21 is detected by a detecting switch 26 close to the actuating member 21 in FIG. 1.

In the actuating member 21, a cam opening 212 is formed to engage with a projection 113 of the childproof lock lever 11. An arm 211*a* is provided on the outer circumference of the actuating member 21, and a blocking portion 211 is provided at the end of the arm 211*a* to get in touch with a blocked portion 212*a* of the second subsidiary lever 17.

The cam opening 212 comprises a first opening portion 212*a* extending away from its center of the actuating member 21 or pivot shaft 213, and a second arc-like opening portion 212*b*.

The projection 113 of the childproof lock lever 11 moves along the first opening portion 212*a* when the actuating member 21 moves from the first position to the second position and vice versa. while the projection 113 moves along the second opening portion 212*b* when the actuating member 21 moves from the second position to the third position and vice versa. Accordingly, when the actuating member 21 turns from the first position to the second position, the childproof lock lever 11 moves from the unlocking position to the locked position, and when the actuating member 21 turns from the second position to the first position, the childproof lock lever 11 moves from the childproof locked position to the childproof unlocking position. Furthermore, when the actuating member 21 turns from the second position to the third position, the childproof lock lever 11 can remain in the childproof lock position.

When the actuating member 21 moves from the first position to the second position, the second subsidiary lever 17 comes off the moving path of the blocked portion 1 73 thereby preventing the second subsidiary lever 17 from going to the unblocking position. When the actuating member 21 moves to the third position, the blocking portion comes within the moving path of the blocked portion 173 of the second subsidiary lever 17 and can contact the blocked portion 173 thereby preventing the second subsidiary lever 17 from moving to the unlocking position.

The childproof-double-lock motor 19 turns in the locking direction with a childproof lock switch (not shown) or a portable remote control switch (not shown) and turns in the unlocking direction with each of the switches. When the childproof lock switch is actuated for locking, the childproof-double-lock motor 19 is controlled to allow the actuating member 21 to stop in the second position based on the detection of the second position of the actuating member 21 with the detection switch 26. When the remote control switch is operated for locking, the actuating member 21 is controlled to turn from the first position to the third position without stopping at the second position. When the remote control switch is operated for unlocking in the double-lock state, the actuating member is controlled to turn from the third position to the first position.

Then, operation of one embodiment of the present invention will be described.

When the Outside Handle 4 or Inside Handle 5 is Operated in the Unlocking Condition When the door latch device 1 is in the unlocking condition in FIG. 4, the first and second lock levers 13,15 and the first and second subsidiary levers 16,17 are in the unlocking position; the childproof lock lever 11 is in the childproof unlocking position; and the actuating member 21 is in the first position. When the outside handle 4 is operated for opening the door, the outer lever 8 turns in the releasing direction, so that the first and second subsidiary levers 16,17 moves forward to allow the releasing-contact portion 174 of the second subsidiary lever 17 to get in touch with the opening lever 2A. Thus, the opening lever 2A turns in the releasing direction to allow the ratchet to disengage from the latch, so that the door can be opened. When the inside handle 5 is operated for opening the door, the first and second inner levers 9,10 turns together in the releasing direction. The contact portion 102 of the second inner lever 10 gets in touch with the bent portion 84 of the outer lever 8 to allow the outer lever 8 to turn in the releasing direction, so that the door can be opened as well.

When the Lock Motor 18 is Operated for Locking in the Unlocking State and When the Lock Knob 6 is Operated for Locking When the lock motor 18 is driven in the locking direction, the second lock lever 15 is driven by the lock motor 18 via the worm 181, worm wheel 20 and gear 201. The second lock lever 15 turns around the pivot shaft 152 from the unlocking position in FIG. 4 to the locked position in FIGS. 2 and 3. The rotation of the second lock lever 15 is transmitted to the second subsidiary lever 17 via the projection 154, slot 162, first subsidiary lever 16 and spring 25 and to the lock knob 6 via the link 16 and first lock lever 13. Thus, the first and second subsidiary levers 16,17, first lock lever 13 and lock knob 6 are moved with the second lock lever 15 from the unlocking position to the locked position to come to the locked state.

In order that the lock knob 6 may be locked, an actuating force of the lock knob 6 is transmitted to the second lock lever 15 via the rod 61, first lock lever 13 and link 14. The second lock lever 15 turns around the pivot shaft 152 from the unlocking position in FIG. 4 to the locked position in FIGS. 2 and 3. The rotation of the second lock lever 15 is transmitted to the first and second subsidiary levers 16,17 as well as the lock motor 18. Thus, the second lock lever 15, first and second subsidiary levers 16,17 are moved from the unlocking position to the locked position and come to the locked state.

When the Door is Opened with the Outside Handle 4 and Inside Handle 5 in the Locked State In the locked state in FIGS. 2 and 3, the lock knob 6, the first and second lock levers 13,15 and the first and second subsidiary levers 16,17 are kept in the locked position respectively. The releasing-contact portion 174 of the second subsidiary lever 17 is in a position where it cannot contact the opening lever 2A. The childproof lock lever 11 and actuating member 21 remain in the childproof locked position and first position respectively.

In order that the door may be opened with the outside handle 4, the outer lever 8 turns in the releasing direction, and the first and second subsidiary lever 16,17 move forward to allow the releasing-contact portion 174 to go in a direction of an arrow C in FIG. 3. But the releasing-contact portion 174 does not contact the opening lever 2A to make it impossible for the opening lever 2A to turn in the releasing direction. So the door cannot be opened with the outside handle 4.

In order that the door may be opened with the inside handle, the locked state is shifted to the unlocking state first and the door is opened second.

Specifically, in the first door-opening operation, the first and second inner levers 9,10 turns toward the releasing position, and the contact portion 102 of the second inner lever 10 gets in touch with the bent portion 84 of the outer lever 8 to allow the outer lever 8 to go in the releasing direction and to allow the first and second subsidiary levers 16,17 to move upward. At the same time, the unlocking portion 92 of the first inner lever 9 gets in touch with the unlocked portion 151 of the second lock lever 15 to allow the second lock lever 15 to turn toward the unlocking position, and the rear edge of the releasing-contact portion 174 of the second subsidiary lever 17 gets in touch with the front end of the opening lever 2A. Thus, the second subsidiary lever 17 stops before the unlocking position. Meanwhile, the first subsidiary lever 16 moves from the locked position to the unlocking position against the force of the spring 25 together with the movement of the second lock lever 15 to the unlocking position while the second subsidiary lever 17 remains before the unlocking position.

Then, the inside handle 5 returns, and the first and second inner levers 9,10 and outer lever 8 returns to the standby position. The first and second subsidiary levers 16,17 go down, and the rear edge of the releasing-contact portion 174 of the second subsidiary lever 17 leaves the front end of the opening lever 2A. Thus, the second subsidiary lever 17 moves to the unlocking position in FIG. 4 owing to the force of the spring 25. The unlocking-position-holding force by the spring 27 exerting the second lock lever 15 and first subsidiary lever 16 is greater than the force by the spring 25 exerting the first subsidiary lever 16, so that the second lock lever 15 and first subsidiary lever 16 still remain even when the inner lever 9 returns to the standby position.

Then, the door can be opened with the inside handle as well as being in the unlocking state.

Childproof locking

In the childproof unlocking state, the actuating member 21 and childproof lock lever 11 are in the first position and childproof unlocking position. When the childproof lock switch is actuated for locking, the actuating member 21 is driven by the childproof-double-lock motor 19 via the worm 191. The actuating member 21 turns around the pivot shaft 213 from the first position to the second position in FIG. 5. Thus, the projection 113 of the childproof lock lever 11 moves along the first opening portion 212*a* of the opening 212 to allow the childproof lock lever 11 to turn around the pivot shaft 111 from the childproof unlock position to the childproof lock position. When the childproof lock lever 11 is shifted to the childproof lock position, the control pin 12 moves in the cam hole 94 of the first inner level 9 to allow it to be shifted to the childproof lock state.

In the childproof lock state and unlocking state, with the outside handle 4, the outer lever 8 is actuated to allow the first and second subsidiary levers 16,17 to go up. So the opening lever 2A is released as well as being in the unlocking state, so that the door can be opened. With the inside handle 5, the second inner lever 10 is not released by the first inner lever 9 although the first inner lever 9 is actuated by the inside handle 5, so that the door cannot be opened.

In the childproof lock state and locked state, the outer lever 8 is actuated with the outside handle 4, but the first and second subsidiary levers 16,17 in the locked position only go up, so that the door cannot be opened as well as being in the locked state. The first inner lever 9 is actuated with the inside handle 5 to allow the unlocking portion 92 of the first inner lever 9 to get in touch with the unlocked portion 151 of the second lock lever 15 in the locked position, thereby moving the second lock lever 15 from the locked position to the unlocking position. Thus, the locked state is shifted to the unlocking state while the childproof lock state still remains. Thereafter, the door cannot be opened by the inside handle 5, but can be opened by the outside handle 4.

Double locking

In the locked state, the actuating member 21 is actuated for locking by the childproof-double-lock motor 19 with the remote control switch. The actuating member 21 turns to the third position from the first position in the childproof unlocking state or from the second position in the childproof lock state. When the actuating member 21 moves form the second position to the third position, the projection 113 of the childproof lock lever 11 moves along the second opening portion 212*b* of the actuating member 21. So the actuating member 21 turns to the third position while the childproof lock lever 11 remains in the childproof lock position. When the actuating member 21 turns to the third position, the blocking portion 211 comes within the moving path of the second subsidiary lever 17 in the blocked portion 17. The second subsidiary lever 17 is held in the locked position of the double-lock state, while the childproof lock lever 11 remains in the childproof lock position in FIG. 6. The single childproof-double-lock lever 19 changes to the childproof lock condition and double lock state.

In the double lock state where the second subsidiary lever 17 is held in the locked position, even if the lock knob 6 is unlocked, the second subsidiary lever 17 cannot be moved to the unlocking position, so that it is not possible to shift to the unlocking state.

Specifically, when the lock knob 6 in the double lock state is operated for unlocking, the first subsidiary lever 16 is actuated by the lock knob 6 via the rod 61, first lock lever 13, link 14 and second lock lever 15. The first subsidiary lever 16 moves from the locked position to the unlocking position against the force of the spring 25 exerting the second subsidiary lever 17 held in the locked position. In this state, even if the unlocking force of the lock knob 6 is removed, the holding force of the spring 27 is greater than that of the spring 25, so that the lock knob 6, first lock lever 13, second lock lever 15 and first subsidiary lever 16 are held in the unlocking position.

Accordingly, in the double lock state, the lock knob 6 can be moved to the unlocking position against the force of the spring 25, but the second subsidiary lever 17 for releasing the engagement of the engagement portion 2 cannot be moved to the unlocking position. The door cannot be opened with the outside handle 4 or inside handle 5, or double actions of the inside handle 5.

As mentioned above, in the double lock state, the lock knob 6 can be moved to the unlocking position against the force of the spring 25. To prevent the second subsidiary lever 17 from moving to the unlocking position, even if the lock knob 6 is wrongfully unlocked, load will apply to the force-transmitting path for transmitting unlocking force of the lock knob 6, thereby preventing part and accessories in the force-transmitting path from being deformed.

Double Lock Releasing

When the childproof-double-lock motor 19 is unlocked with the remote control switch, the actuating member 21 is driven via the worm 191. The actuating member 21 turns from the third position to the first position, so that the blocking portion 211 goes out of the moving path of the blocked portion 173 of the second subsidiary lever 17. When the actuating member 21 turns from the second position to the first position, the projection 113 of the childproof lock lever 11 is guided along the first opening portion 212*a* of the opening 212 to allow the childproof lock lever 11 to move from the childproof lock position to the childproof unlock position. Accordingly, the single childproof-double-lock motor 19 moves the actuating member 21 from the third position to the first position thereby carrying out both operation shifting from the double lock state to the double unlock state and operation moving for shifting the childproof lock lever 11 from the childproof lock position to the childproof unlock position.

If the first and second lock levers 13,15 and first subsidiary lever 16 moves to the unlocking position by unlocking the lock knob 6 in the double lock state, the actuating member 21 is moved by the childproof-double-lock motor 19 from the third position to the first position, thereby moving the second subsidiary lever 17 with the spring 25 to the unlocking position to carry out shifting to the unlocking state.

One embodiment of the present invention was described above. Various modifications and variations may be made by a person skilled in the art without departing from the scope of claims.

i/ The first subsidiary lever is formed integrally with the second subsidiary lever.

ii/ A lock knob is directly coupled to the second lock lever with a rod without a first lock lever or a link.

What is claimed is:

1. A door latch device in a door of a motor vehicle, comprising:

an engagement portion, comprising:

a latch which engages with a striker of a vehicle body of the motor vehicle;

a ratchet which engages with the latch; and an opening lever which can rotate with the ratchet;

at least one lock lever moving between an unlocking position where the latch can be disengaged from the striker and a locked position where the latch cannot be disengaged from the striker with a lock knob on the door inside the vehicle;

a first subsidiary lever connected to the lock lever to move between an unlocking position where the latch can be disengaged from the striker with an outside handle on the door outside the vehicle or with the inside handle and a locked position where the latch cannot be disengaged from the striker;

a second subsidiary lever connected to the first subsidiary lever, the second subsidiary lever having a releasing-contact portion which comes in contact with the opening lever of the engagement portion when the second subsidiary lever is in the unlocking position, while the releasing-contact portion does not come in contact with the opening lever when the second subsidiary lever is in the locked position;

a first inner lever connected to an inside handle on the door inside the vehicle and pivotally mounted on a pivot shaft;

a second inner lever pivotally mounted on the pivot shaft;

a childproof lock lever connected to the first and second inner levers to move between a childproof unlock position where the inside handle moves the second subsidiary lever via the first and second inner levers to release the latch from the striker and a childproof lock position where the inside handle does not move the second subsidiary lever via the first and second inner levers;

a childproof-double-lock motor; and a single actuating member driven by the childproof-double-lock motor to move the childproof lock lever between the childproof unlock position and the childproof lock position, the actuating member moving among a first position, a second position and a third position, the first position of the actuating member moving the childproof lock lever to the childproof unlock position, the second position of the actuating member moving the childproof lock lever to the childproof lock position, the third position of the actuating member holding the subsidiary lever in the locked position.

2. The door latch device of claim 1 wherein the actuating member comprises a blocking portion, the actuating member in the first and second positions going out of a moving path of a blocked portion of the second subsidiary lever to enable the second subsidiary lever to move to the unlocking position, the actuating member in the third position coming within the moving path of the blocked portion.

3. The door latch device of claim 1 wherein the actuating member is pivotally mounted and comprises a cam opening along which a projection of the childproof lock lever is in sliding engagement, the actuating member moving to the first position to move the childproof lock lever to the childproof unlock position; moving to the second position to move the childproof lock lever to the childproof lock position; and moving to the third position to hold the childproof lock lever in the childproof lock position.

4. The door latch device of claim 3 wherein the cam opening comprises a first opening portion and a second opening portion comprising an arc of a circle around a center of the actuating member, a projection of the childproof lock lever moving along the first opening portion from the first position to the second position and vice versa, the actuating member moving from the second position to the third position and vice versa to enable the projection to go along the second opening portion.

5. The door latch device of claim 1 wherein the first and second subsidiary levers are in the unlocking position to release the latch from the striker by releasing the first and second inner levers, the second subsidiary lever being connected to move together with the first subsidiary lever by a force of a spring acting between the second subsidiary lever and the first subsidiary lever, the lock lever and the first subsidiary lever moving from the locked position to the unlocking position against the force of the spring while the second subsidiary lever is held in the locked position when the actuating member is in the third position.

* * * * *